US009708805B2

(12) United States Patent
Seggio

(10) Patent No.: US 9,708,805 B2
(45) Date of Patent: Jul. 18, 2017

(54) PERIODIC HEAVY FLUSH VALVE CONTROL DEVICE, METHOD AND SYSTEM

(71) Applicant: AS IP Holdco, LLC, Piscataway, NJ (US)

(72) Inventor: Frank Seggio, Wayside, NJ (US)

(73) Assignee: AS IP Holdco, LLC, Piscataway, NJ (US)

( * ) Notice: Subject to any disclaimer, the term of this patent is extended or adjusted under 35 U.S.C. 154(b) by 322 days.

(21) Appl. No.: 14/252,960

(22) Filed: Apr. 15, 2014

(65) Prior Publication Data

US 2014/0304902 A1 Oct. 16, 2014

Related U.S. Application Data

(60) Provisional application No. 61/812,483, filed on Apr. 16, 2013, provisional application No. 61/863,661, filed on Aug. 8, 2013.

(51) Int. Cl.

| | |
|---|---|
| ***E03D 5/12*** | (2006.01) |
| ***E03D 5/10*** | (2006.01) |
| ***E03C 1/122*** | (2006.01) |
| ***E03D 3/02*** | (2006.01) |

(52) U.S. Cl.

CPC ..... *E03D 5/12* (2013.01); *E03C 1/122* (2013.01); *E03D 3/02* (2013.01); *E03D 5/105* (2013.01); *Y10T 137/86405* (2015.04)

(58) Field of Classification Search

CPC .. E03D 5/12; E03D 5/10; E03D 5/105; E03D 13/007

See application file for complete search history.

(56) References Cited

U.S. PATENT DOCUMENTS

| | | | | |
|---|---|---|---|---|
| 5,187,818 | A | 2/1993 | Barrett, Sr. et al. | |
| 5,301,373 | A | 4/1994 | Hull et al. | |
| 6,560,790 | B2 | 5/2003 | Saar et al. | |
| 6,742,194 | B2 | 6/2004 | Shim | |
| 6,862,754 | B1 | 3/2005 | DeMarco | |
| 8,037,551 | B2 | 10/2011 | Wilson et al. | |
| 8,152,135 | B2 | 4/2012 | Maercovich | |
| 8,234,724 | B2 | 8/2012 | Wilson et al. | |
| 8,397,319 | B1 | 3/2013 | Senderak | |
| 2010/0012196 | A1* | 1/2010 | Maercovich | E03D 3/06 137/1 |

OTHER PUBLICATIONS

International Search Report, International Application No. PCT/US2014/034079, Date of Mailing Aug. 28, 2014.

* cited by examiner

*Primary Examiner* — Janie Loeppke
(74) *Attorney, Agent, or Firm* — Kramer Levin Naftalis & Frankel LLP

(57) ABSTRACT

The smaller volumes of water currently required to flush toilets and urinals may be insufficient to clear the fixtures and the drainage lines to which they are connected of waste and other undesirable materials, which can build up over a period of flushes or non-use. A flush valve control device programmed or otherwise configured to provide a selectable, periodic heavier flush volume of water after a predetermined number of low volume flushes and/or after a predetermined period of inactivity of the toilet or urinal can provide for sufficient drainage line carry-out of waste and prevent undesirable buildup of minerals, etc. on the inside surfaces of the fixtures and drainage pipes.

20 Claims, 3 Drawing Sheets

PERIODIC HEAVY FLUSH VALVE CONTROL DEVICE, METHOD AND SYSTEM

CROSS-REFERENCE TO RELATED PROVISIONAL APPLICATIONS

This application claims the benefit of U.S. Provisional Patent Application Nos. 61/812,483 filed on Apr. 16, 2013, and 61/863,661 filed on Aug. 8, 2013, the disclosures of both of which are hereby incorporated herein by reference in their entireties.

FIELD OF THE INVENTION

The present invention generally relates to devices, methods and systems for controlling the flushing of sanitaryware connected to a drainage system.

BACKGROUND OF THE INVENTION

Sanitaryware, such as toilets and urinals, and the pipes they connect to, deliver waste from within a structure (e.g., a commercial building or a residence) to sewer or septic systems. Applicable plumbing codes and proper installation practices prescribe the size, type, pitch and layout of the drainage pipes to ensure that waste will run downhill through the pipes to the sewer or septic systems without clogging the pipes. With new construction, there is the opportunity to match the sanitaryware with a pipe system that is designed to work with the sanitaryware to provide a drainage system designed to avoid blockages. However, when sanitaryware are connected to a drainage system that is not so matched, such as during bathroom remodeling when new sanitaryware are connected to older pipes, there is an increased risk of blockages. Cleaning out a clogged drainage system can be a daunting and expensive undertaking.

Regarding the sanitaryware, a toilet is generally either of the type that relies on a water storage tank to force Water into the bowl causing it to "flush" or of the type that does not. In most cases, urinals don't rely on water storage tanks as a water delivery system.

Tank toilets, which are common in residential settings, are gravity-powered. With siphonic toilets, for example, when the toilet is flushed, the water in the tank rushes down with enough force to activate a siphon, which is a tube at the bottom of the bowl fixture. The siphon pulls the water and waste out of the bowl and into the drainage line. A flush valve controls the flow of water from the tank into the bowl.

Tankless toilets, which are common in commercial and/or public settings, receive water directly from a supply line at a high enough pressure that a single flush can carry waste through the drainage system. Tankless toilets use approximately the same amount of water as a tank-type toilet. For the most part, these toilets are powered using only the force of water entering from the supply line (in buildings where water pressure is an issue, the flush can be assisted by pumps). Tankless toilets generally need about 25 psi or more of water pressure to function properly. Most urinals require less water pressure (and much less water to complete a flush) because they flush liquid not solid waste.

Most tankless toilets and urinals operate using a flush valve that is metered with either a piston or a diaphragm. The valve is designed to shut automatically after completing a flush cycle.

With the advent of low flush volume toilets and urinals, the proper flushing and purging of the drainage system has become a serious concern. For example, a decade ago, it was not uncommon to have a toilet use in excess of 3 gallons of water per flush. Given present day water conservation efforts, various plumbing codes currently mandate that toilets use a maximum of 1.1 or 1.28 or 1.6 gallons per flush (typically less for urinals). This presents the problem of providing enough water per flush for sufficient drainage line carry-out of solid waste and to prevent undesirable buildup of minerals, etc. on the inside surfaces of the fixtures and drainage pipes. The problem is compounded by government incentives, such as Leadership in Energy and Environmental Design ("LEED"), a voluntary, consensus-based, market-driven program that provides third-party verification of green buildings, and similar programs that incentivize building owners to reduce water consumption, without regard to the consequential, negative effects on fixtures and drainage, systems.

There is therefore a need for a way to provide for water conservation while minimizing the negative effects of the reduced water flow in low flow sanitaryware fixtures and drainage pipe systems.

SUMMARY OF THE INVENTION

Generally speaking, it is an object of the present invention to provide a control device, method and system for effecting a selectable, periodic heavier flush volume of water after a preselected number of normal low volume flushes and/or after a preselected period of inactivity of the toilet or urinal to provide sufficient drainage line carry-out of waste and to prevent undesirable buildup of minerals, etc. on the inside surfaces of the fixtures and drainage pipes.

Still other objects and advantages of the present invention will in part be obvious and will in part be apparent from the specification.

The present invention accordingly comprises the features of construction, combination of elements, arrangement of parts, and the various steps and the relation of one or more of such steps with respect to each of the others, all as exemplified in the constructions herein set forth, and the scope of the invention will be indicated in the claims.

BRIEF DESCRIPTION OF TUE DRAWINGS

For a fuller understanding of the inventive embodiments, reference is had to the following description taken in connection with the accompanying drawings in which.

DETAILED DESCRIPTION OF THE PREFERRED EMBODIMENTS

The present invention provides embodiments of a periodic heavy flush valve control device (hereinafter, "PHFD"), method and system that cause the flush valve to periodically effect a heavy flush sufficient to help purge (in whole or in part) the fixture (especially, the trap) and the drainage line to which it is connected of undesirable blockages caused by waste and mineral buildup. The flush volume (which can be based on the duration of the flush) can be selected/adjusted to ensure that it is within the capability of the sanitaryware to drain that amount of water without overflow. This heavy flush exceeds the prescribed flush volume for a normal flush; i.e., it can be greater—even much greater—than the current normal 1.1, 1.28 or 1.6 gallons for toilets and 0.5 or 1 gallon for urinals. By way of example, and without limitation, the heavy flush volume can range from about 10% greater than a normal flush to as much as 3, 4 or 5 gallons or more.

The PHFD can be a separate device from the flush valve. As such, it can be attached directly to the drainage line system to permit purging.

According to one embodiment of the present invention, the PHFD functionality can be incorporated into the sanitaryware flush valve itself as a suitably programmed expansion of the valve functionality. This presumes use of an electronic flush valve, such as for example an American Standard SELECTRONIC™ flush valve.

Figure 1:
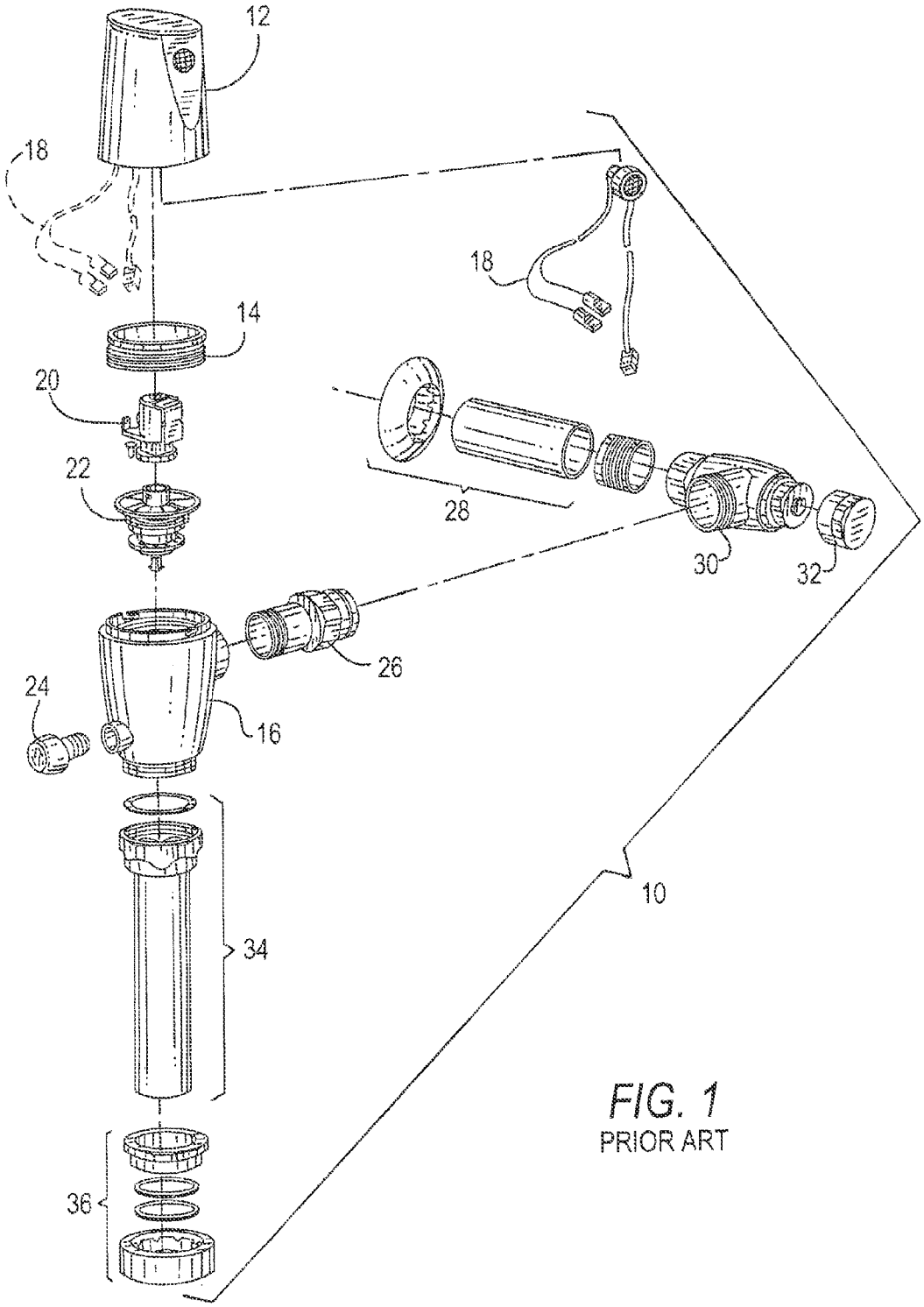
FIG. 1 PRIOR ART
FIG. 1 is an exploded view of an exemplary commercially available flush valve for a commercial tankless toilet.

FIG. 1 is an exploded view of an American Standard SELECTRONIC™ proximity toilet flush valve 10—an exemplary commercially available flush valve for a commercial tankless toilet (1.1, 1.28 and 1.6 gallons-per-flush or "GPF"). The flush valve 10, which can be battery' powered, includes a cover assembly 12, which connects (e.g., via a bonnet nut 14) to a main body 16. The cover assembly 12 houses a sensor assembly 18; the main body 16 houses a solenoid valve and piston subassembly including a solenoid valve assembly 20 and a piston assembly 22. A manual valve 24 connects to the main body 16, as does an adjustable tailpiece 26. The adjustable tailpiece 26 connects the main body 16 to an inlet, pipe assembly 28 via a supply stop 30 (with cap 32). A vacuum breaker assembly 34 also connects to the main body 16; an escutcheon assembly 36, in turn, connects to the vacuum breaker assembly 34.

Figure 2B:
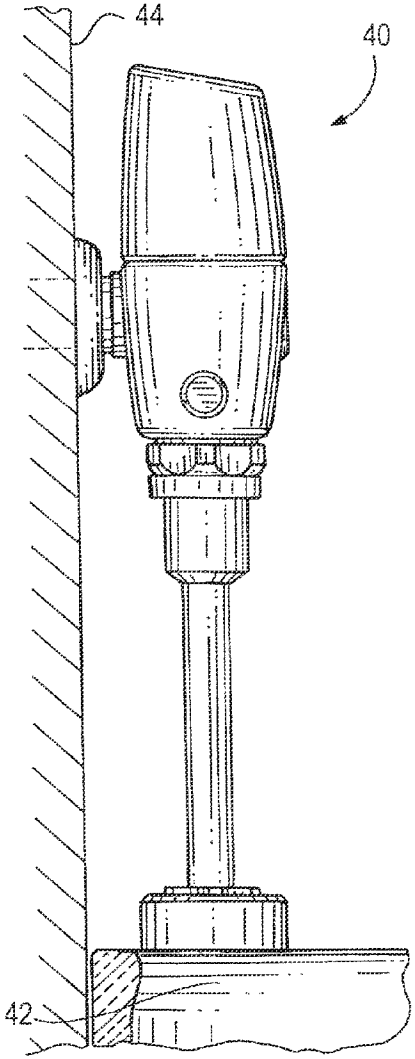
FIG. 2B PRIOR ART
FIGS. 2A and 2B depict an exemplary commercially available flush valve for a urinal (front and side views)
Figure 2A:
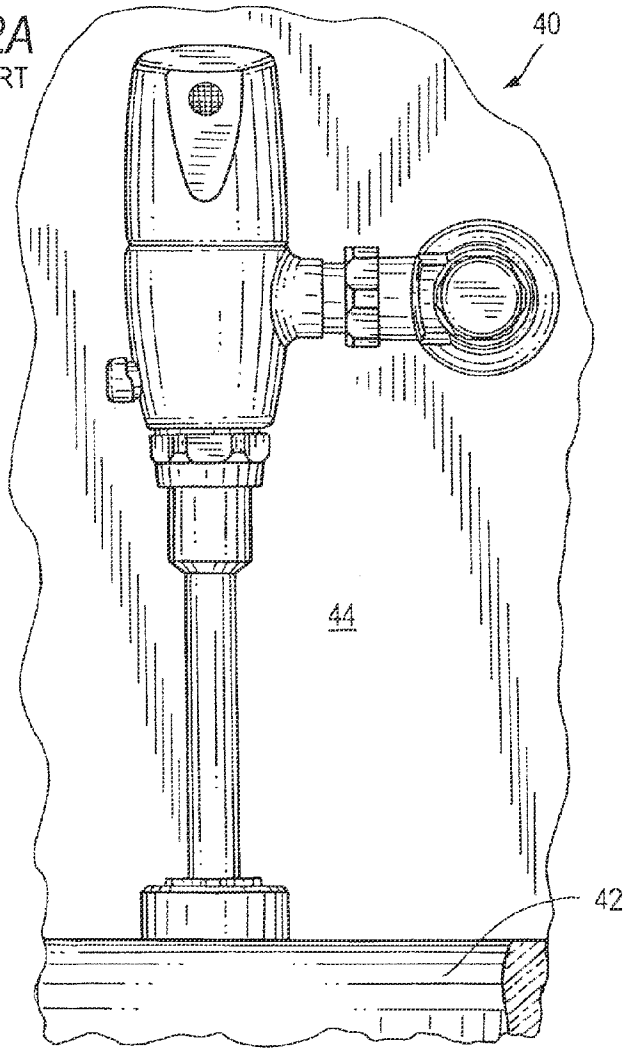
FIG. 2A PRIOR ART

FIGS. 2A and 2B show front and side views, respectively, of an American Standard SELECTRONIC™ urinal flush valve 40—an exemplary commercially available, battery powered, sensor operated flush valve for a urinal (1 GPF), Flush valve 40 is shown mounted both atop a urinal 42 and to the plumbing behind a bathroom wall 44.

Advantageously, flush valves of the type under consideration can receive the programmed PHFD functionality and any adjustments thereto using a remote programmer/control device. Indeed, the sanitaryware flush valve sensor assembly (see, e.g., sensor assembly 18 shown in FIG. 1) can include a multi-function sensor, which can be suitably programmed with the PHFD functionality. Such a sensor can be provided for use on a variety of types of sanitaryware fixture—with the programming adapting it to its particular function for the particular fixture on which it is used.

By incorporating the PHFD functionality into toilet or urinal flush valves, the flush valves can provide normal, efficient flush volumes when not providing heavy periodic flushes. Advantageously, by virtue of the PHFD functionality, normal flush volumes can even be further reduced (further aiding water conservation efforts), as the periodic heavy flushes can be programmed or adjusted (in intensity and/or periodicity) to compensate for the lower flush volumes while ensuring sufficient fixture (especially, trap) and drainage line clearance.

PHFDs can be strategically located (and enabled or disabled as appropriate) at different points of the drainage system where low usage or insufficiently pitched pipes may benefit from the periodic higher flush volume of water to help purge the drainage lines. Periodic delivery of larger flush volumes to the drainage system based on the location of the flush valves enables a coordinated and networked system approach to balancing water conservation efforts and drainage line clearance requirements.

Figure 3:
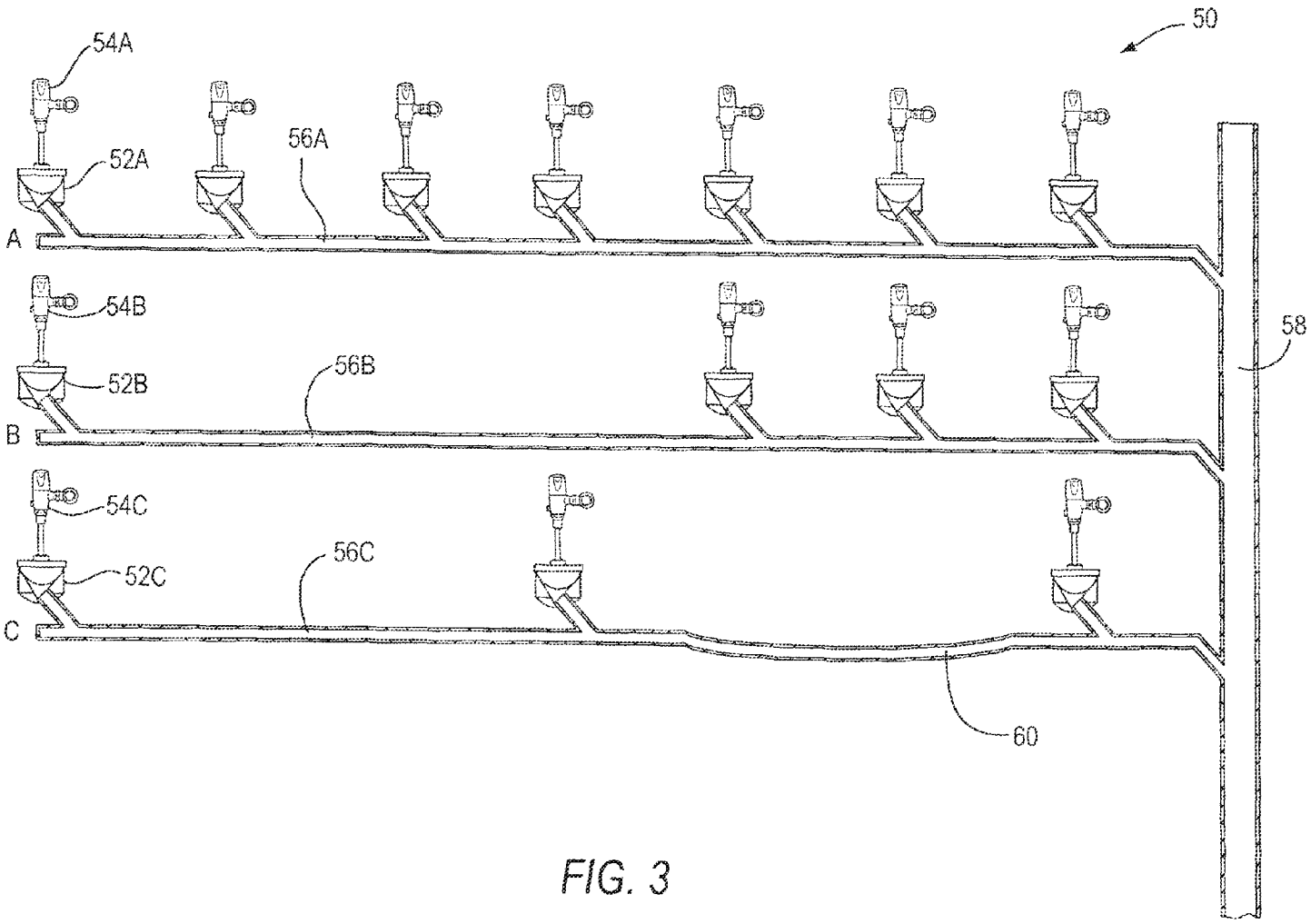
FIG. 3 depicts an exemplary layout of a plumbing system including sanitaryware fixtures strategically equipped with periodic heavy flush valve control devices in accordance with embodiments of the present invention.

FIG. 3 depicts an exemplary layout of a building plumbing system illustrating how/where inventive PHFDs may be deployed to address drainage line carry-out with high efficiency toilets ("HET") and/or ultra-high efficiency toilets ("UHETs"). At upper level A, seven frequently used toilets 52A equipped with inventive PHFD functional flush valves 54A share a common branch drainage line 56A, which feeds into a main drainage line 58. At mid-level B, four toilets 52B equipped with inventive PHFD functional flush valves 54B share a common branch drainage line 56B feeding into the main line 58, with one seldom-used fixture occupying the distal end of the branch line remote from the other three more frequently used fixtures on the common line. At lower level C, three toilets 52C equipped with inventive PHFD functional flush valves 54C share a common branch drainage line 56C feeding into the main line 58. The toilets 52C are disposed at spaced-apart points on the line; and an undesirable sag 60 in the drainage line 56C exists between two of the fixtures.

According to one embodiment of the present invention, the flush valve can be controlled to execute a heavy, drainage-purging flush after a preselected number (or count) of normal flushes. Referring to FIG. 3, the middle of the seven frequently used toilets 52A is a good candidate for such drainage line purge flushing based on the number of uses.

An alternative embodiment utilizes a selectable period of inactivity to execute the heavy, drain-purging flush. ideally, this functionality can be provided on the drainage line at the end of one of the farthest locations (main or branch lines) from the building drain exit to help purge the entire drainage line (enabling a drainage line purge cycle). The selectable period of inactivity for execution of the flush can be anywhere from hours to days to avoid wasting water while helping to prevent blockages. The amount of water flushed for this periodic flush is also adjustable to avoid wasting water and to ensure that the fixture or pipe it is attached to can handle the volume of water without issue. Referring to FIG. 3, the toilets 52B and 52C that occupy the respective ends of the branch lines 56B and 56C farthest from the main line 58 are good candidates for such drainage line purge flushing based on period of non-use.

Another embodiment combines both the selectable period of inactivity and the selectable count of normal flushes with independent resulting selectable flush volumes. Referring to FIG. 3, the middle of the three toilets 52C, given its upstream proximity to the drainage line sag 60, is a good candidate for drainage line purge flushing at a selected high flush volume based on one or both of the number of uses and period of non-use.

Additionally, the periodic heavy flushes can be programmed to execute at preselected times periods during the day or night. This can take into account the variations in available water pressure based on building water usage.

Accordingly, the inventive embodiments capitalize on the use of high efficiency, low water volume flush valve systems without a drastic impact on LEED or similar conservation credit calculations. Effecting periodic heavy flushes after a selectable period of flush valve inactivity or a selectable number of normal flushes, combined with a selectable flush volume, is salutary in that it permits maximum water savings of high efficiency toilets, urinals, and related flush valves while providing enough frequency and flush volume to minimize drainage line build-up or blockages.

Table 1 below illustrates water conservation benefits of using inventive PHFDs with ultra-high efficiency sanitaryware fixtures compared to less efficient fixtures such as, for example, standard 1.6 GPF flushing systems.

TABLE 1

| | # Toilets | Flush Volume | Flushes/Day | Total Gallons | Savings (gal.) | % Savings vs. 1.6 GPF |
|---|---|---|---|---|---|---|
| 1.6 GPF Standard Toilets | 14 | 1.60 | 10 | 224.0 | 0 | 0% |
| 1.28 GPF HET Toilets | 14 | 1.28 | 10 | 179.2 | 44.8 | 20% |
| 1.10 GPF UHET Toilet Systems. | 14 | 1.10 | 10 | 154.0 | | |
| Additional flush from time out 'non-use' | 3 | 1.60 | 3 | 14.4 | | |
| | | | | 168.4 | 55.6 | 25% |
| 1.10 GPF UHET Toilet Systems. | 14 | 1.10 | 8 | 123.2 | | |
| 1 heavy flush every 5 flushes | 14 | 1.60 | 2 | 44.8 | | |
| | | | | 168.0 | 56.0 | 25% |
| 1.10 GPF UHET Toilet Systems. | 11 | 1.1 | 10 | 121.0 | | |
| 3 heavy flushes/day | 3 | 1.1 | 7 | 23.1 | | |
| for 3 flush valves based on count usage | 3 | 1.6 | 3 | 14.4 | | |
| | | | | 158.5 | 65.5 | 29% |

Moreover, the inventive embodiments provide building owners with the salutary capability to adjust the drainage profile of their buildings' drainage systems as a whole as needed via selective control of the sanitaryware flush valves. This is particularly advantageous for buildings where the pipes are sealed behind walls, above ceilings and under floors, and, from a practical standpoint, it is not an option to change them. Referring to FIG. 3, a good example of this is the capability to enlist and fully leverage the middle of the three toilets 52C to effect drainage line purge flushes to address the drainage issues presented by the drainage line sag 60.

It should be appreciated that the inventive embodiments constitute a significant contribution to the art. The closest-appearing art includes flush valves that can merely provide an automatic 24 hour sanitary flush, which is typically a full flush (based on rating of flush valve installed) or a short flush after an inactivity period of 24 hours, While this provides a cleansing flush for the toilets or urinals and/or provides water to maintain the drain trap seal preventing sewer gases from coming up through the fixtures), it does nothing to ensure that flush volumes are adequate to clear and keep the drainage lines free of blockages, let alone take into account the location of the flush valve in the drainage system for the purpose of purging it.

Embodiments of the present invention can be implemented in the form of control logic in software or hardware or a combination of both. For example, particular embodiments can be implemented by using application specific integrated circuits or programmed logic circuits, in general, the functions of particular embodiments can be achieved by any suitable means as is known in the art. Communication or transfer of data or instructions may be wired, wireless, or by any other suitable means. Also, elements of the inventive embodiments can be enabled or disabled as is useful in accordance with a particular application.

Furthermore, it should be understood that the aspects, features and advantages made apparent from the foregoing are efficiently attained and, since certain changes may be made in the disclosed inventive embodiments without departing from the spirit and scope of the invention, it is intended that all matter contained herein shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A method for purging a low flush volume sanitaryware fixture and connected plumbing drainage line, the method comprising automatically periodically effecting a single flush of the sanitaryware fixture having a heavy flush volume at a preselectable time or after at least one of a preselected number of low volume flushes and a preselected period of inactivity of the sanitaryware fixture, the heavy flush volume being a volume of water exceeding a flush volume for a normal flush of the sanitaryware fixture and within the capability of the sanitaryware fixture to drain the volume of water without overflowing, such that the heavy flush volume purges the drainage line to a greater extent than the normal flush or combination of normal flushes.

2. The method of claim 1, wherein the sanitaryware fixture is a toilet.

3. The method of claim 1, wherein the sanitaryware fixture is a urinal.

4. The method of claim 1, wherein the heavy flush volume exceeds the flush volume for the normal flush by at least ten percent.

5. The method of claim 4, wherein the heavy flush volume is in a range of about 3 to 5 gallons of water.

6. The method of claim 1, wherein the heavy flush volume is adjustable.

7. The method of claim 6, wherein the heavy flush volume after the preselected number of low volume flushes is different from the heavy flush volume after the preselected period of inactivity of the sanitaryware fixture.

8. The method of claim 1, wherein the preselectable time is based at least in part on available water pressure.

9. The method of claim 1, wherein the sanitaryware fixture is one of a plurality of sanitaryware fixtures in a building, and wherein the heavy flush volume is based at least in part on location of the sanitaryware fixtures within the building.

10. A sanitaryware flush valve configured to effect the method of claim 1.

11. A sanitaryware flush valve, comprising a sensor, the sensor being remotely programmable to effect the method of claim 1.

12. A periodic heavy flush valve control device configured to control a flush valve to effect the method of claim 1.

13. A sanitaryware fixture, comprising a flush valve configured to effect the method of claim 1.

14. The sanitaryware fixture of claim 13, wherein the flush valve is one of a toilet flush valve and a urinal flush valve.

15. A plumbing system for a building, comprising at least one building drainage line, at least one sanitaryware fixture connected to the at least one drainage line, the at least one sanitaryware fixture including a flush valve, the flush valve being configured to automatically periodically effect a single flush having a heavy flush volume at a preselectable time or after at least one of a preselected number of low volume flushes and a preselected period of inactivity of the at least one sanitaryware fixture, the heavy flush volume being a volume of water exceeding a flush volume for a normal flush of the at least one sanitaryware fixture and within the capability of the at least one sanitaryware fixture to drain the volume of water without overflowing, such that the heavy flush volume purges the drainage line to a greater extent than the normal flush or combination of normal flushes.

16. The system of claim 15, wherein the at least one sanitaryware fixture is a toilet.

17. The system of claim 15, wherein the at least one sanitaryware fixture is a urinal.

18. The system of claim 15, further comprising a sensor, the sensor being remotely programmable to cause the flush valve to automatically periodically effect the flush having the heavy flush volume.

19. The system of claim 15, further comprising a periodic heavy flush valve control device configured to control the flush valve to automatically periodically effect the flush having the heavy flush volume.

20. The system of claim 15, wherein the at least one sanitaryware fixture is a plurality of sanitaryware fixtures, and wherein the heavy flush volume is based at least in part on location of the sanitaryware fixtures within the building.

* * * * *